US009766013B2

(12) United States Patent
Elliott et al.

(10) Patent No.: US 9,766,013 B2
(45) Date of Patent: Sep. 19, 2017

(54) DRYING DEVICES

(75) Inventors: Jack Bernard Elliott, Brighton (GB); David Kenneth Elliott, Strood Rochester (GB)

(73) Assignee: DIRECT AIR DRYERS LIMITED, Llantrisant, Wales (GB)

( * ) Notice: Subject to any disclaimer, the term of this patent is extended or adjusted under 35 U.S.C. 154(b) by 281 days.

(21) Appl. No.: 13/261,688

(22) PCT Filed: Jan. 9, 2012

(86) PCT No.: PCT/GB2012/000009

§ 371 (c)(1),
(2), (4) Date: Jul. 11, 2013

(87) PCT Pub. No.: WO2012/095624

PCT Pub. Date: Jul. 19, 2012

(65) Prior Publication Data

US 2014/0310977 A1 Oct. 23, 2014

(30) Foreign Application Priority Data

Jan. 13, 2011 (GB) ..... 1100529.5

(51) Int. Cl.

| | |
|---|---|
| ***F26B 3/00*** | (2006.01) |
| ***F26B 21/00*** | (2006.01) |
| ***E04B 1/70*** | (2006.01) |
| ***F26B 9/00*** | (2006.01) |

(52) U.S. Cl.

CPC ..... *F26B 21/004* (2013.01); *E04B 1/7092* (2013.01); *F26B 9/006* (2013.01); *F26B 21/001* (2013.01)

(58) Field of Classification Search

CPC ..... E04B 1/7092

See application file for complete search history.

(56) References Cited

U.S. PATENT DOCUMENTS

| | | | | |
|---|---|---|---|---|
| 3,344,569 | A | 10/1967 | Cotten | |
| 5,199,232 | A | 4/1993 | Chandler et al. | |
| 5,367,842 | A | 11/1994 | Janesky | |
| 5,408,759 | A | 4/1995 | Bass | |
| 2002/0133877 | A1* | 9/2002 | Kuiper et al. | 5/81.1 R |
| 2006/0272176 | A1* | 12/2006 | Elliott et al. | 34/523 |

FOREIGN PATENT DOCUMENTS

| | | | |
|---|---|---|---|
| DE | 3306044 | A1 | 8/1984 |
| GB | 2397366 | A | 7/2004 |
| GB | 2397366 | B | 5/2005 |
| GB | 2423810 | A | 9/2006 |
| GB | 2475556 | A | 5/2011 |
| JP | 2004261788 | A | 9/2004 |

* cited by examiner

*Primary Examiner* — Jason Lau
(74) *Attorney, Agent, or Firm* — King & Schickli, PLLC

(57) ABSTRACT

A drying device for a wall structure includes an inflatable drying mat (1) of lightweight plastic sheeting and a floor engaging portion (2), a wall engaging portion (3), an outwardly facing portion (4) that extends between an outer edge portion (5) of the floor engaging portion (2) and an upper edge portion (6) of the wall engaging portion (3) to define a triangular cross-section when in use and connected to an air mover. In use of the drying device, a deflated mat (1) is laid on a floor and against a wall structure to be dried. The air mover is then powered up whereupon the mat (1) is deployed automatically against the wall to a height in excess of one meter without any outside assistance.

5 Claims, 1 Drawing Sheet

DRYING DEVICES

This invention is concerned with improvements in or relating to a drying device and is particularly concerned with improvements in or relating to a drying device for use in the drying out of walls of a building following the subjection of the walls to an excess of water during a flood or a deluge occasioned by burst pipes from above.

By drying device where used herein, it is meant a flexible mat that in use is laid against, or caused to lie against at least a first one meter portion of a wall as measured from the floor level.

When a building, which may be a dwelling, offices, shop premises or an industrial building, is flooded by an inrush of water or is subjected to a deluge from above, which may be caused by burst pipes or a leaking roof, it is most usual for the walls to be wetted above a level of more than one meter from the floor level of the wall.

However, when the floodwaters recede or the deluge from above is addressed, the water on or within a wall will rapidly find its own level due to gravity and or the porosity of the wall structure; thus, it is of paramount import that the wall is subjected to a drying treatment at the earliest possible time after the floodwaters recede or the deluge from above ceases.

Previous arrangements for drying out a wall have usually addressed the problem by attaching wall mats to the whole wall; this procedure is somewhat redundant in the light of the comments herein relating to the water level that remains in a wall after the floodwater has receded or deluge from above has stopped.

The present invention provides a method of drying a wall structure using a drying device provided by an inflatable mat comprising, when in use:

(a) a floor engaging portion;
(b) a wall engaging portion;
(c) an outwardly facing portion that extends between an outer edge portion of the floor engaging portion and an upper edge portion of the wall engaging portion to define, in use, a triangular cross section;
(d) opposite end portions that effectively close the drying device to form an inflatable configuration when in use; and
(e) the floor engaging portion and the wall engaging portion having a plurality of apertures for directing air from an air mover against a floor and wall structure to be dried when carrying out the method of drying;

the method comprising the steps of:

laying the drying device on the floor with a forward portion thereof against the wall structure:
(ii) attaching an air mover to an outer edge portion of the drying device; and
(iii) powering the air mover to cause air under pressure to pass into the drying device whereby the drying device is inflated to be automatically deployed against the wall structure to a height of at least one meter from the floor without additional involvement of an operative.

The present invention also provides a drying device for drying a wall structure, the device being provided by an inflatable, flexible mat comprising:

(a) a floor engaging portion;
(b) a wall engaging portion;
(c) an outwardly facing portion that extends between an outer edge portion of the floor engaging portion and an upper edge portion of the wall engaging portion to define, in use, a triangular cross-section;

(d) opposite end portions that effectively close the drying device to form an inflatable configuration when in use; and
(e) the floor engaging portion and the wall engaging portion having a plurality of apertures for directing air from an air mover against a floor and wall structure, when the drying device is in use;

wherein the following steps are taken when the device is in use:

(i) laying the drying device on the floor with a forward portion thereof against the wall structure;
(ii) attaching an air mover to an outer edge portion of the drying device; and
(iii) powering the air mover to cause air under pressure to pass into the drying device whereby the drying device is inflated to be automatically deployed against the wall structure to a height of at least one meter from the floor without additional involvement of an operative.

Thus, the present invention provides a more efficient and less costly way of drying out a wall, the present invention comprising a flexible mat of at least one meter in height when deployed, in use, against a wall, the flexible mat being configured in cross-section similarly to a retaining wall structure in that it comprises a floor engaging surface, a wall engaging surface and an outwardly facing surface that extends between an outer edge portion of the floor engaging surface and an upper edge portion of the wall engaging surface.

The flexible mat may conveniently comprise an attachment for directing air, heated or otherwise, into apertures provided in a wall against which the flexible mat is located.

More conveniently, the attachment may comprise a flexible tunnel-like apparatus having an open mouth portion at a upstream end thereof and a nozzle at an downstream end portion thereof, whereby, when the flexible mat is in use and air, heated or otherwise is provided from an air blower, may pass through the tunnel-like apparatus and through the nozzle into a space behind a wall that is being dried so that the wall is dried on each side thereof.

Preferably, the flexible tunnel-like apparatus may be attached to openings formed between the wall engaging portion and the floor-engaging portion of the mat.

Conveniently, both the tunnel-like apparatus and the flexible mat are provided with Velcro (RTM) covered edge portions that facilitate the mutual attachment one to the other.

There now follows by way of example of the invention, a detailed description, which is to be read with reference to the accompanying drawings in which.

Figure 1:
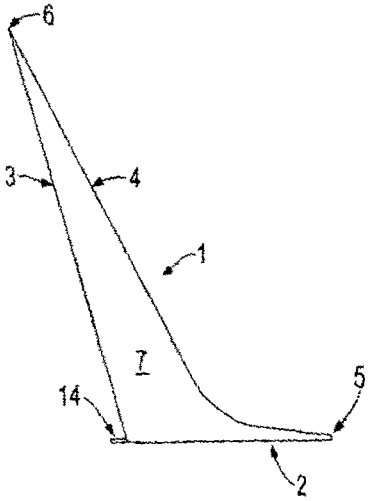
FIG. 1 shows a left hand end of a flexible mat of the invention as deployed when in use.
Figure 2:
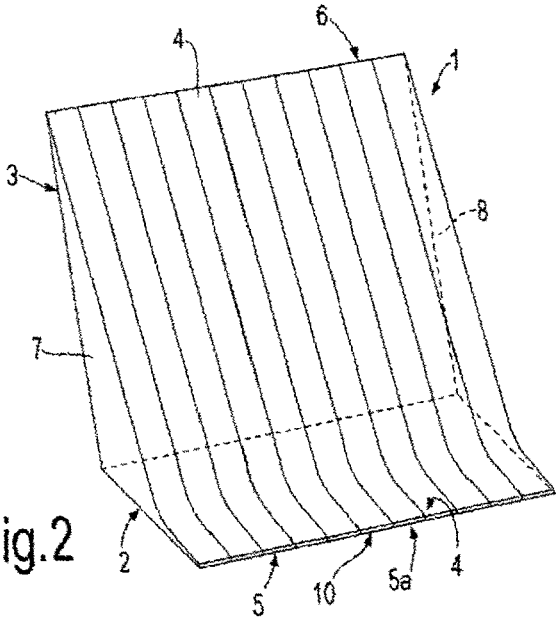
FIG. 2 is an upper perspective view showing hidden detail of the flexible mat; and, FIG. 3 is an upper perspective view of an attachment for the flexible mat.
Figure 3:
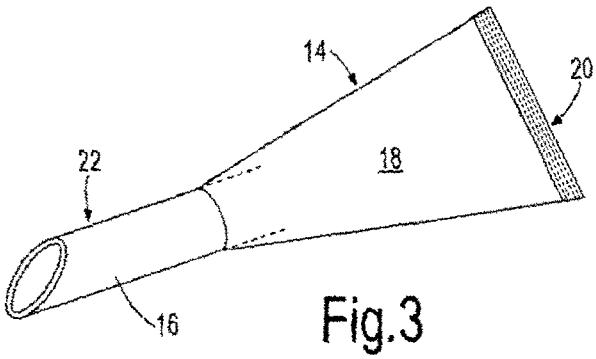

The present invention provides, see FIGS. 1 to 3, a flexible drying mat 1 made of lightweight plastic sheeting and generally comprising a floor engaging portion 2, a wall engaging portion 3, an outwardly facing portion 4 that extends between an outer edge portion 5 of the floor engaging portion 2 and an upper edge portion 6 of the wall engaging portion to define a triangular cross-section of similar configuration to that of a retaining wall structure.

The flexible drying mat 1 also comprises opposite end portions 7 and 8 that effectively close the flexible drying mat 1 to form an inflatable configuration when in use as will be explained in detail hereinafter.

The flexible drying mat 1 may be of any length commensurate with meeting the requirements for drying out a water-damaged wall. Several mats 1 may be arranged in end-to-end juxtaposition along a wall, not shown.

The flexible drying mat 1 further comprises a multiplicity of spaced apertures, not shown, in the floor engaging portion 2 and the wall engaging portion 3.

The outwardly facing portion 4 is connected to the floor engaging portion 2 and the wall engaging portion 3 by tag elements, not shown, of various lengths commensurate with attaining the desired wall engaging relationship when deployed against a wall. The tag elements, which are of any suitable material, are secured by stitching, or other suitable means, to inside surface of the floor engaging portion 2, the wall engaging portion 3 and the outwardly facing portion 4 respectively.

The flexible drying mat 1 is provided with a portion 10 between a mid portion 5*a* of the floor engaging portion 2 and a mid portion 4*b* of the outwardly facing portion 4, which portion 10 is closed by strips of Velcro (RTM), not shown.

When a mat 1 of the present invention is in use, an air mover, not shown, is connected to the mat 1 by opening the portion 10 and closing the Velcro strips onto like strips provided on the air mover.

Important features of the flexible drying mat are:

a) its lightweight structure and its flexibility that facilitates the collapsing of the mat 1 and enabling it to be rolled up for storage in a suitable container for transport;

b) the ease with which it may be deployed in use; and, c) the effectiveness of the deployed mat in applying the drying air from an air mover directly onto the portion of a wall that retains the residue of floodwater thereby leading to a speedy and efficient remedy of the situation.

When a flexible drying mat 1 of the present invention is to be used in drying out a water damaged wall, an operative unpacks a mat 1 and unrolls the mat 1 to lie against the bottom of a wall, not shown. An air mover is connected to the mat 1 at the portion 10 by separating the Velcro strips, not shown, and closing the strips about like strips on a mouth of the air mover.

The air mover is powered with the result that air under pressure passes into the mat 1 causing the mat to be automatically deployed against a wall with no requirement for means for fixing the mat 1 to the wall.

Air from the air mover 12, heated or not, passes through the multiplicity of apertures in the floor engaging portion 2 and the wall engaging portion 3 to impinge upon a floor portion adjacent the wall and the wall up to a height of at least one meter from the floor The present invention also includes a funnel-like apparatus 14 that is attached to the flexible mat 1 when it is required that the inside of a wall, not shown, is to be dried out concomitantly with the drying out of an outside of the wall.

To this end, the funnel-like apparatus 14 comprises a first portion 18 of flexible material having an upstream mouth portion 20 that is attached, in use, to an associated aperture, not shown, that is provided in the flexible mat 1 at a juncture of the floor engaging portion 2 and the wall engaging portion 3 thereof.

Both the mouth portion 20 and the aperture at said juncture of the portions 2 and 3 respectively, of the flexible mat 1, are provided with strips of Velcro (RTM) in order to facilitate the attachment of the apparatus 14 to the mat 1.

The funnel-like apparatus 14 is also provided with a nozzle 16 at a downstream portion 22 of the apparatus 14, which nozzle 16, when the mat 1 is in use and the inside of a wall is to be dried out concomitantly with the drying out of an outside of the wall, is inserted in a prepared aperture (not shown) that extends through the wall.

Thus upon powering up of an air mover connected to the mat 1, heated air, or air at ambient temperature, is caused to flow through the multiplicity of apertures in the wall engaging portion 3 and through the funnel-like apparatus 14 to impinge on the outside and inside of the wall respectively.

It has been found that the flexible drying mat 1 of the present invention, if used within a short period of time from the incidence of damage by floodwater or from a deluge from above caused by burst pipes, the advantages are that:

(i) there is no requirement to strip out the wall plaster or other surface facade;

(ii) the incidence of spoor growth is avoided;

(iii) the wall is dried in a faster time than hitherto possible by current methods and appliances;

(iv) the building is returned to the owners for use with a minimum of delay;

(v) there is no requirement to affix the novel drying mat to a wall surface unlike the pre-requisite that prior devices need to be affixed to a wall when in use; and, (vi) because of the nature of the novel drying mat, in that no fixings are required when it is used, the use of the mat is non-invasive, except for apertures provided for acceptance of the nozzles 16 of the funnel-like apparatus 14, resulting in no undue damage to a main surface of the wall against which it is used.

It is to be appreciated that modifications may be made within the scope of the invention described herein; for example, the lightweight plastic sheeting of the flexible mat 1 may be replaced by any suitable material commensurate with achieving the quick rehabilitation of a flood damaged building.

Likewise, the funnel-like apparatus may be made from any flexible material, for example, fabric, thin gauge plastic, rubber or the like materials commensurate with ensuring the effective drying operation of the mat 1.

The nozzle 16 may also be made of any suitable materials, for example, plastic, metal or a moulded composite commensurate with ensuring the durability of the nozzle 16.

The invention claimed is:

1. An inflatable drying device for drying, in conjunction with an air mover, a vertical wall surface extending from a horizontal floor surface, the device comprising:

(a) a floor engaging portion extending outwardly, in use, from the wall;

(b) a wall engaging portion engageable at its upper edge with the wall;

(c) an outwardly facing portion extending between an outer edge portion of the floor engaging portion and an upper edge portion of the wall engaging portion to collectively define, in use, a generally triangular structure in which only the upper edge of the wall engaging portion is engageable with the wall;

(d) respectively opposite end portions of the device by which the floor engaging portion, the wall engaging portion, and the outwardly facing portion are closed to collectively form an inflatable structure; and (e) the floor engaging portion and the wall engaging portion of the device having a plurality of apertures for directing air from the air mover against the floor surface and the wall surface, when the drying device is in use and air is blown into the drying device, the apertures are sized to permit sufficient outflow of air to dry the wall and floor while permitting the generally triangular structure of the device to be maintained during the drying process.

2. A drying device for drying a wall structure according to claim 1, characterised in that the outwardly facing portion of the drying device is connected internally to the floor engaging portion and the wall engaging portion by tag elements of various lengths commensurate with attaining a desired wall and floor engaging relationship when the drying device is in use, and further characterised in that the tag elements are secured to inside surfaces of the floor engaging portion, the wall engaging portion and the outwardly facing portion of the drying device.

3. A drying device for drying a wall structure according to claim 1, characterised in that the drying device is provided with attachment means for an air mover, said attachment means comprising inter-engaging portions of the outwardly facing portion and the floor engaging portion respectively, which inter-engaging portions comprise oppositely facing hook and loop strips that are arranged in mutual engagement with the strips of the outwardly facing portion and the floor engaging portion when the drying device is in use.

4. A drying device for drying a wall structure according to claim 1, characterised in that the drying device is formed of flexible materials.

5. A drying device for drying a wall structure according to claim 1, characterised in that the drying device also comprises at least one funnel-like apparatus that is attached thereto in use, each funnel-like apparatus comprising a first portion of flexible material having a mouth portion that is attached, in use, to an associated aperture provided in the drying device at a juncture of the floor engaging portion and the wall engaging portion, the funnel-like apparatus also comprising a nozzle at a downstream portion, which nozzle is inserted in a prepared aperture in the wall structure so that both sides of the wall structure are subjected to air form the air mover when the drying device is in use.

* * * * *